US010712115B2

(12) United States Patent
Corona et al.

(10) Patent No.: US 10,712,115 B2
(45) Date of Patent: Jul. 14, 2020

(54) MODULAR TURRET

(71) Applicant: CMI Defence S.A., Loncin (BE)

(72) Inventors: Fabian Corona, Retinne (BE); Vincent Dumont, Vise (BE); Alberto Da Costa Garcia, Soumagne (BE); Henri Orban, Eben-Emael (BE); Philippe Delvaux, Beaufays (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 16/307,945

(22) PCT Filed: Jun. 7, 2017

(86) PCT No.: PCT/EP2017/063876
§ 371 (c)(1),
(2) Date: Dec. 7, 2018

(87) PCT Pub. No.: WO2017/211911
PCT Pub. Date: Dec. 14, 2017

(65) Prior Publication Data

US 2019/0310046 A1 Oct. 10, 2019

Related U.S. Application Data

(60) Provisional application No. 62/348,177, filed on Jun. 10, 2016.

(30) Foreign Application Priority Data

Oct. 10, 2016 (EP) ..... 16193124

(51) Int. Cl.
*F41A 23/24* (2006.01)
*F41H 5/20* (2006.01)
*F41H 7/04* (2006.01)

(52) U.S. Cl.
CPC ..... *F41A 23/24* (2013.01); *F41H 5/20* (2013.01); *F41H 7/044* (2013.01); *F41H 7/048* (2013.01)

(58) Field of Classification Search
CPC ..... F41H 5/20; F41H 7/04
See application file for complete search history.

(56) References Cited

U.S. PATENT DOCUMENTS 3,566,742 A 3/1971 Bemiss
4,412,122 A 10/1983 Bohm et al.
(Continued)

FOREIGN PATENT DOCUMENTS

DE 3836718 A1 5/1990
DE 19720815 A1 11/1998
(Continued)

OTHER PUBLICATIONS

Christopher F Foss: "Flexible firepower: Modular approach pays for the new Cockerill turret family", Jane's International Defence Review, vol. 48, No. 7, Jul. 1, 2015 (Jul. 1, 2015), pp. 28-29, XP001596293.

*Primary Examiner* — J. Woodrow Eldred
(74) *Attorney, Agent, or Firm* — Leydig, Voit & Mayer, Ltd.

(57) ABSTRACT

A modular turret for an armored vehicle includes: an invariable and unique basic structural unit configured to be interchangeable, called a standard shell, equipped with interface means; and a plurality of interchangeable and removable functional modules and/or systems securable to the standard shell by specific fastening means distinctive from a connection of each functional module to the standard shell. The interface means allow an assembly of a set of different modules and/or systems of a same functional type on the standard shell at an interfacing zone on the latter. The standard shell includes an assembly of a plurality of plates
(Continued)

with different shapes and sizes giving the standard shell a geometric shape with fixed dimensions. The plates have orifices and/or connectors for fastening the interchangeable and removable functional modules and/or systems. The plurality of plates includes a base metal sheet including a base of the standard shell.

18 Claims, 5 Drawing Sheets

(56) References Cited

U.S. PATENT DOCUMENTS

| | | | | |
|---|---|---|---|---|
| 4,601,230 | A | 7/1986 | Leblanc | |
| 5,129,307 | A | 7/1992 | Cain et al. | |
| 7,513,187 | B1 | 4/2009 | Lambermont | |
| 8,910,559 | B1 * | 12/2014 | Berman | F41H 5/263 89/36.08 |
| 9,194,664 | B1 | 11/2015 | Smith | |
| 2004/0183322 | A1 | 9/2004 | Baus et al. | |
| 2005/0115396 | A1 | 6/2005 | Patry et al. | |
| 2006/0005695 | A1 | 1/2006 | Honlinger et al. | |
| 2009/0114085 | A1 | 5/2009 | Diller et al. | |
| 2009/0320346 | A1 | 12/2009 | Gablowski | |
| 2016/0169628 | A1 * | 6/2016 | Domholt | F41A 27/20 89/41.01 |
| 2016/0258704 | A1 | 9/2016 | Hobson | |

FOREIGN PATENT DOCUMENTS

| | | | |
|---|---|---|---|
| EP | 0844455 | A2 | 5/1998 |
| EP | 1318374 | A2 | 6/2003 |
| EP | 1468240 | A1 | 10/2004 |
| EP | 1508765 | A1 | 2/2005 |
| EP | 1930685 | A1 | 6/2008 |
| EP | 1955003 | A1 | 8/2008 |
| EP | 2151659 | A2 | 2/2010 |
| EP | 2195601 | A1 | 6/2010 |
| FR | 2579946 | A1 | 10/1986 |
| FR | 3017700 | A1 | 8/2015 |
| WO | WO 9417357 | A1 | 8/1994 |
| WO | WO 2004017012 | A1 | 2/2004 |
| WO | WO 2009004136 | A1 | 1/2009 |
| WO | WO 2013010110 | A2 | 1/2013 |
| WO | WO 2013127654 | A1 | 9/2013 |
| WO | WO 2013183047 | A1 | 12/2013 |
| WO | WO 2015004568 | A1 | 1/2015 |
| WO | WO 2015004569 | A1 | 1/2015 |
| WO | WO 2016060719 | A2 | 4/2016 |

* cited by examiner

MODULAR TURRET

CROSS-REFERENCE TO PRIOR APPLICATIONS

This application is a U.S. National Phase application under 35 U.S.C. § 371 of International Application No. PCT/EP2017/063876, filed on Jun. 7, 2017, and claims benefit to European Patent Application No. EP 16193124.1, filed on Oct. 10, 2016, and U.S. Provisional Patent Application No. 62/348,177, filed on Jun. 10, 2016. The International Application was published in French on Dec. 14, 2017 as WO 2017/211911 under PCT Article 21(2).

FIELD

The present invention relates to the technological field of incorporating cannons with different calibers onto a standard and interchangeable shell, said cannons covering the range of medium and large calibers, in other words between 20 mm and 130 mm, and said standard and interchangeable shell being considered to be the base structure of a modular turret mounted on any armored vehicle.

By definition, the shell is the armored framework in and/or on which it is possible to insert and/or attach, via separate interfaces, at least systematically or optionally, one (or a suitable combination of) element(s) such as the variable-caliber cannon (from medium to large), an aiming system, a basket containing a set of electronic and mechanical components, a bustle rack containing the medium or large caliber ammunition, a missile launching system, a close-up observation system, etc.

BACKGROUND

In general, the development of a turret considers several specific parameters, which, in most cases and to the extent possible, lead to the development of a single structure resulting from the optimization of each of these parameters.

The aforementioned parameters pertain to:

- the mass of the turret,
- the ballistic protection,
- the caliber of the primary weapon, namely the cannon,
- the quantity and type of ammunition to be stored, and the means for loading the latter (manual or automatic),
- the dimensions of the vehicle on which the turret is associated,
- the transport means of the vehicle/turret assembly,
- the contractual constraints imposed by the user,
- etc.

Thus, the turrets typically designed are non-interchangeable or even non-modular, which means that it is necessary to redefine a complete structure for each new user and/or each new mission.

In other words, upstream, the base element, the shell, or even its architecture are subject to the same parameters, i.e., it is only usable under very specific conditions. That is why the modularity of the turret is often reduced to its simplest expression in light of the unique nature of each developed project. For each new project, it is necessary to re-think the architectural design based on the user's needs, which means that in turn, the shell is not interchangeable with respect to certain inner and/or outer modules.

Currently, the proposed solutions are based on the fact that the shell of the turret is defined based on the specificities requested by the user, without taking into account the interchangeability of certain structures to be grafted. In other words, in most configurations, the modularity aspect is not present, given that the design of said shell is associated with a single project.

The following documents have been identified in the state of the art.

In document US 20040183322, a tank provided with a passenger compartment supported by traction means using tracks and an armed station positioned on the roof of the passenger compartment such that inside the latter is divided into three regions: i) "front", in which the traction mechanisms and the driver's seat are located, ii) "rear", where the crew seats appear, and iii) "intermediate", suitable for different purposes depending on the design of the vehicle, in particular for the adaptation of the turret and/or at least one seat for the operators of the armed station and/or a storage compartment for ammunition and loading devices. The first two regions have the same function for all alternatives of the vehicle, while the third region is freer.

Document WO2009004136 discloses a light military vehicle combining a chassis equipped with mobility means and at least one armored passenger cabin fastened to the chassis such that it can be disassembled by securing means.

Document WO2004017012 discloses a rolling armored vehicle formed by several compartments: i) a traction section, and ii) a mission section able to be detached from the rear part of the traction section and able to be coupled thereto via a vertical separation plane.

Document WO2013127654 discloses a turret for an armored vehicle including an invariable and rigid metal structural unit having a central position in the turret, on the one hand, and at least one interchangeable module able to be disassembled by securing means, on the other hand.

Document FR 2,579,946 discloses a versatile motor vehicle with tracks comprising a shell with tracks. On the horizontal top of the chassis of the shell, a plane is applied, on the upper face of which an element is mounted completing the architecture of the vehicle, quick assembly means being provided both for mounting the interface on the chassis of the shell and for mounting the element completing the architecture of the vehicle.

Document DE19720815 discloses a combat structure having various divided zones, one of which relates to the combat zone able to accommodate crewmembers as well as a set of electronic elements and a cooling system.

Document FR 3,017,700 discloses a modular weapon station comprising a rotating frame suitable for being mounted on a platform, and including a removable cradle with a weapon mounted thereon.

Document DE3836718 discloses a turret characterized by a specific journal system making it possible to interchange a 105 mm caliber cannon and a 120 mm caliber cannon simply by modifying the height of the journal axis for armored vehicles of different sizes.

Document WO 2015/004569 A1 discloses a turret comprising a hollow casing provided with a gun, such as a cannon, said casing comprising: a front portion or shell, on which there is mounted said gun and which defines a front cavity, which at least partially houses said gun; and a rear portion or tail, which defines a rear cavity, which houses at least one between a projectile magazine and a mechanism to load the projectiles into the breech of said gun; said front portion or shell and said rear portion or tail being distinct from one another and being mutually mechanically assembled so that said cavities at least partially communicate with one another.

Other documents, such as EP 2,151,659, EP 1,318,374, EP 2,195,601, EP 1,955,003, EP 1,508,765, EP 1,468,240, U.S. Pat. No. 9,194,664, WO 2013/010110, U.S. Pat. Nos. 7,513,187, 4,601,230, 3,566,742 and WO 2016/060719, are of some interest, but are less significant than the documents described above.

This approach can be likened to an automobile assembly line, where the shell is associated with the chassis, and the set of inner and/or outer modules is defined as being the component elements of the final vehicle corresponding to the user's wishes and the functional, operational, ecological, etc. market requirements/standards.

SUMMARY

In an embodiment, the present invention provides a modular turret for an armored vehicle, comprising: an invariable and unique basic structural unit configured to be interchangeable, called a standard shell, equipped with interface means; and a plurality of interchangeable and removable functional modules and/or systems securable to the standard shell by specific fastening means distinctive from a connection of each functional module to the standard shell, the interface means being configured to allow an assembly of a set of different modules and/or systems of a same functional type on the standard shell at an interfacing zone on the latter, wherein the standard shell comprises an assembly of a plurality of plates with different shapes and sizes giving the standard shell a geometric shape with fixed dimensions, the plates having orifices and/or connectors configured to fasten the interchangeable and removable functional modules and/or systems, the plurality of plates comprising: a base metal sheet comprising a base of the standard shell over an entire surface area thereof, and a center of which is pierced to define a fastening of a ring; two cannon support plates situated in front of the standard shell, and positioned perpendicular relative to the base metal sheet, each of the two cannot support plates comprising an orifice configured to receive a cannon module and/or secondary weapon module; side metal sheets starting from the cannon support plates, following the base metal sheet to end behind the standard shell; an interface plate connecting the side metal sheet to a rear of the standard shell perpendicular to the base metal sheet, the interface plate comprising a fastening means for a bustle rack; upper metal sheets cooperating with the cannon support plates, the side metal sheets, and the interface plate so as to close the standard shell, and wherein the standard shell further comprises: two arches providing a junction between the front and rear of the standard shell, the two arches having a fixed height and forming a rectilinear channel extending from the cannon support plates to the interface plate, so that the arches define, inside the standard shell, three invariable zones independently of an actual cannon module, a position of the arches defining fictive plans which, once extended downward with respect to the base metal sheet, make similarly appear the three invariable zones at a level of a basket mounted on the standard shell; and a cover, over the arches, a shape and/or height of which reflects a recoil created by the cannon module.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
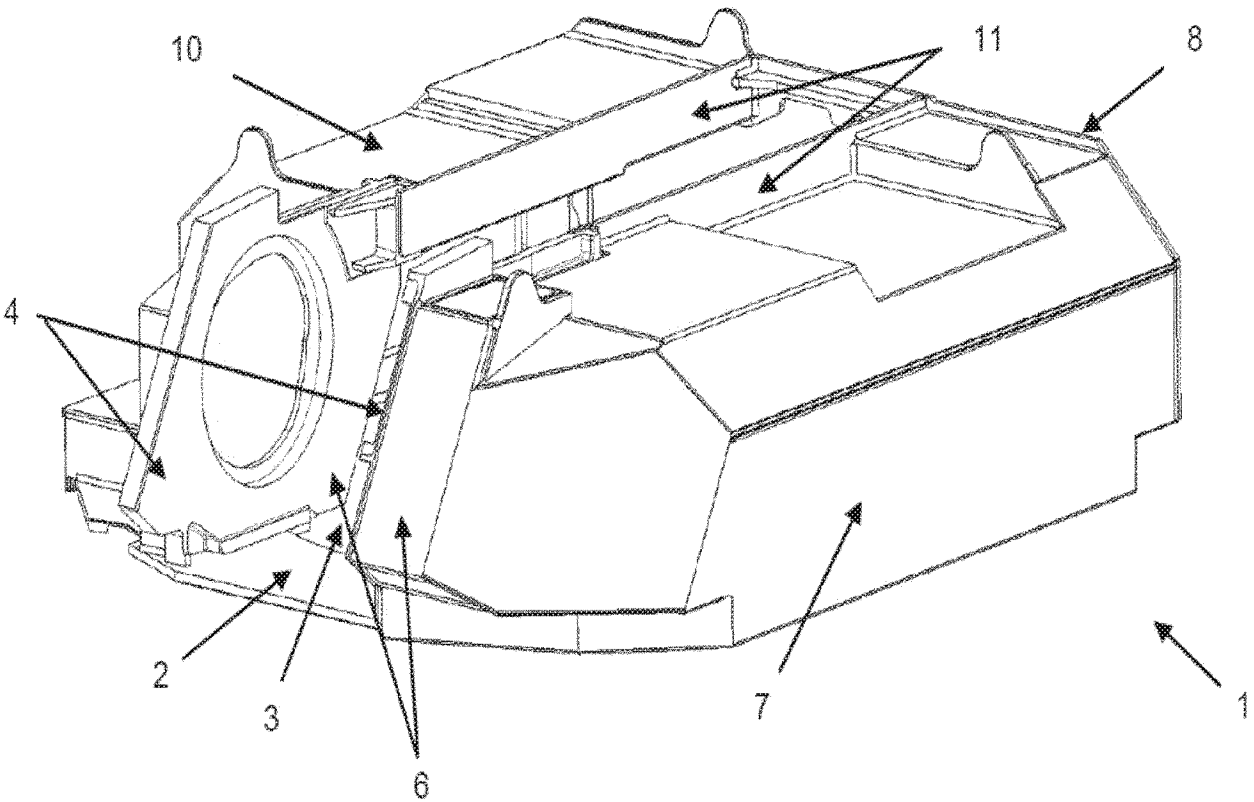
FIG. 1 shows a perspective view of a standard and interchangeable modular turret shell according to the present invention, with its various armor plates.

The present invention relates to the placement of a standard and interchangeable architecture for the part commonly called shell of the turret, like an automotive chassis where many electrical, electronic and mechanical elements considered to be indispensable and functional are attached.

More specifically, the invention provides a standard and interchangeable structure for said shell, characterized in that it has a very broad set of interface means allowing the systematic or optional attachment thereto of at least one series of inner equipment (basket, etc.) and/or specific outer equipment (weapons of different calibers, close-up observation system(s), etc.) such that the occupants of the turret, i.e., the commander and the gunner, are situated in a similar environment at all times, in other words an environment that is independent of the number and type of modules and/or systems associated with the standard and interchangeable shell. The project is therefore based on a notion of "commonality" with respect to the management of the various pieces of equipment. The level of commonality is a Frenglish term used in the automotive field to designate the number of parts, subassemblies, and assemblies shared by several vehicle models.

In other words, in embodiments the inside of the standard and interchangeable shell, and ultimately the turret, have a minimal arrangement respected in all possible configurations, in other words, the basic workspace for the members of the crew remains identical in each structure, given that the layout of the inner systems respects a same philosophy. What must be standardized is the HMI (Human Machine Interface) corresponding to the various electronic and mechanical control devices of the turret.

According to the invention, a standard and interchangeable shell has the possibility of being attached, systematically (for example, in the case of the cannon) or optionally (in other cases of modules and/or systems), to at least one or a suitable combination of the structures described below, corresponding to interchangeable and removable modules and/or systems:

- a cannon module comprising at least one cannon having a caliber comprised between 20 mm and 130 mm, which covers the range of medium and large calibers,
- an ammunition storage module containing at least one support structure, the bustle rack, and an automatic or manual loading system,
- a basket intended to receive a crew (made up of one to two people) and materials (screens, levers, seats, etc.) necessary for the latter to steer the turret, and to shoot,
- a module having at least one secondary weapon comparable to a small-caliber coaxial machine gun comprised between 5.56 mm and 15 mm, an aiming system,
one or more additional armor systems,
a missile launcher system,
a grenade launcher system,
a radio communication system,
a close-up observation system,
a weather station system,
episcopes,
hatches,
a roof weapon system,
a laser beam detection system,
a navigation system,
an electronic control system,
a power system,
an armored "boresight" system,
etc.

In fine, the standard and interchangeable shell has fixed interfaces rather than interchangeable parts within the latter.

From a practical and functional perspective, it should be noted that in certain scenarios, the basket is not integrated into said standard and interchangeable shell. In this scenario, it is completely missing from the enclosure, given that the manipulations related to the operation of the turret are done directly from the inside of the armored vehicle itself by a crew member. As a result, the commander and the gunner are not installed at the basket, but inside the vehicle.

The project currently developed makes it possible to reach very high operational, functional, ergonomic, economic, etc. levels due to the interchangeability and standardization of the shell. Said interchangeability is a major asset to quickly and effectively respond to various interior and/or exterior changes related to arrangements on the shell, and in fine the turret, to align with the various specificities requested by the user and/or the current mission.

Thus, in fine, the architecture of the turret is obtained by implementing predefined modules and/or interior and/or exterior systems attached on the standard and interchangeable shell, such that the various assembly combinations of said modules and/or systems constitute a new modular turret meeting the standard requirements. Owing to the interchangeability and standardization of the shell, different alternatives of the turret will be proposed.

It should be noted that the set of predefined modules is known in itself by one skilled in the art, and does not constitute the heart of the invention.

One embodiment for carrying out the invention discloses a modular turret for an armored vehicle, on the one hand comprising an invariable and unique basic structural unit able to be interchangeable, called standard and interchangeable shell, equipped with interface means, and on the other hand, a plurality of interchangeable and removable functional modules and/or systems, able to be secured to the standard shell by specific fastening means distinctive from the connection of each functional module to said standard shell, the interface means thus being designed to allow the assembly of the set of different modules and/or systems of the same functional type on said standard shell at an interfacing zone on the latter, said standard shell comprising the assembly of a plurality of plates with different shapes and sizes giving the standard shell a geometric shape with fixed dimensions, said plates being able to have orifices and/or connectors for fastening said interchangeable and removable functional modules and/or systems.

According to the invention, said plurality of plates at least comprises:

a base metal sheet making up the base of the standard shell over the entire surface area thereof, and the center of which is pierced to define the fastening of a ring;

two cannon support plates situated in front of the standard shell, and positioned perpendicular relative to the base metal sheet, each of the plates comprising an orifice intended to receive a cannon module and/or secondary weapon module;

side metal sheets starting from the cannon support plates, following the base metal sheet to end behind the standard shell;

an interface plate connecting the side metal sheet to the rear of the standard shell perpendicular to the base metal sheet, said interface plate being a fastening means for a bustle rack;

upper metal sheets cooperating with the cannon support plates, the side metal sheets and the interface plate to close the standard shell;

said standard shell being characterized in that it further comprises:

arches providing the junction between the front and rear of the standard shell, having a fixed height and forming a rectilinear channel extending from the cannon support plates to the interface plate, so that said arches define, inside the standard shell, three invariable zones from a functional and structural perspective, independently of the actual cannon module, i.e., a zone for hosting the gunner on the right, looking from the front of the vehicle, a zone for hosting the commander on the left, and a central zone intended to receive the primary weapon; the position of the arches defining fictive plans which, once extended downward with respect to the base metal sheet, make similarly appear the three aforementioned zones at the level of a basket optionally mounted on the standard shell; and a cover, over the arches, the shape and/or height of which depending on the recoil created by the cannon module.

According to preferred embodiments, the modular turret further includes, systematically or optionally, at least one of the following features or an appropriate combination of several of them:

the interchangeable and removable functional modules and/or systems are selected from the group made up of a cannon module in a specific caliber range, for medium to large calibers, a small-caliber secondary weapon module, a basket, an aiming system, an ammunition storage or bustle rack module, an over-shield kit, a missile launcher system, a grenade launcher system, a close-up observation system, a radio communication system, a weather station, hatches, episcopes, a roof weapon system, a laser beam detection system, a navigation system, an electronic control system, a power system, an under-shield "boresight" system, etc.;

the caliber of the cannon module is comprised between 20 and 130 mm;

said side metal sheets have an angle smaller than 90° relative to the base metal sheet on the front face of the standard and interchangeable shell, and are welded perpendicular to the base metal sheet on the lateral sides;

the cannon module is interfaced with the standard and interchangeable shell between the cannon support plates, either via a support, mask and rolling bearings, or via journals, ball joints and flanges, the fastening method being designed to be independent of the caliber of the cannon module;

the secondary weapon module, the caliber of which is preferably comprised between 5.56 mm and 15 mm, is interfaced with the standard and interchangeable shell, either jointly with the cannon module between the cannon support plates at the mask associated with the standard and interchangeable shell such that the cannon module and the secondary weapon module are both fastened on the mask linked to the standard interchangeable shell, or outside said cannon support plates such that the secondary weapon module is integrated outside said mask, or both at once between and outside the cannon support plates, the fastening methods being designed all to be independent from the caliber of the cannon module;

the main axis of the secondary weapon module is oriented in the same direction and sense as the main axis of the cannon module, in other words, such that a coaxiality appears between the two weapons;

the ammunition storage or bustle rack module is interfaced with the standard and interchangeable shell behind the latter via the interface plate acting as bustle rack fastening means, the latter respectively being:

in direct relation with the standard and interchangeable shell in the case of the medium-caliber cannon module, such that an ammunition rack of the modular turret simultaneously straddles the standard and interchangeable shell and the bustle rack, the interface plate marrying the base and side metal sheets preferably over a width of several millimeters;

in indirect relation with the standard and interchangeable shell in the case of the large-caliber cannon module, following the presence of a firewall, i.e., an additional plate used to isolate the storage compartment from the ammunition i) in case of fire, ii) in order to increase the ballistic degree, iii) in order to increase protection in case of explosion of the ammunition, iv) etc., comparable to a complete junction, the interface plate closing the entire rear surface area of the standard and interchangeable shell by connecting the base and side metal sheets, the bustle rack containing the ammunition intended to be conveyed to the cannon module automatically, respectively:

longitudinally along the axis thereof by the large-caliber cannon module, and transversely to the axis thereof by the medium-caliber cannon module, the plurality of interchangeable and removable functional modules and/or systems is specifically attached to the same locations of the standard and interchangeable shell without modifying the structural and functional aspects of the standard and interchangeable shell and independently of the caliber of the cannon module;

the unused interfacing zones are covered with closed blank plates, optionally armored using an additional armoring kit;

the assembly of the plurality of plates with different shapes and sizes giving the standard and interchangeable shell a geometric shape with fixed dimensions is a mechanically welded assembly, while the cover, optional, is attached to said standard and interchangeable shell using screws;

the plurality of interchangeable and removable functional modules and/or systems, irrespective of their specificity, is attached to the same locations of the standard and interchangeable shell, this association, in terms of the geometry of the standard and interchangeable shell as well as the fastening methods, being independent of the number and nature of said modules and/or systems, whether they are interior and/or exterior, such that the environment in which the crew of the modular turret is found, made up of no more than two people, i.e., a commander and a gunner, remains identical at all times while the configuration of the modular turret is not frozen in time, but can evolve over time, for example depending on updates as well as requests from the user, i.e., the standard and interchangeable shell or the modular turret is based on a commonality of the management of the various aforementioned modules and/or systems.

The base element covered by the invention is the shell.

From a structural perspective, this is an immutable element of the modular turret, which means that it is considered standard. This element is made up of several plates with different shapes and sizes, some of which can have circular, square, rectangular, etc. openings.

These plates, assembled by welding, give a precise geometric shape to the standard shell defined by the specific dimensions that will later create its modularity, the shape accounting for several separate characteristics, namely the rigidity, mass, ergonomics, etc., or even in some cases, the aerodynamics, aesthetics, etc. It appears that this assembly is independent of the number and nature of the attached interior and/or exterior modules and/or systems, but the dimensions are frozen at a given moment "t", in other words, only the development (configuration) of the standard shell can undergo certain modifications based on requests by the user. That is why, owing to this notion of commonality/standardization, the reactivity time with respect to any adaptations is very short in order to meet the user's requirements quickly and effectively.

Furthermore, over the entire surface of the standard shell, interfacing zones appear with said modules and/or systems via a set of connections and appropriate securing means. These zones are located in strategic locations defined both by the user and the stakes of the mission. If these zones are unused, they can of course be covered by blank plates in order to optimize the specific characteristics described above, as well as the interior and exterior security of the standard shell (the overall level of armoring is described below).

In most of the situations encountered, these various pieces of interior and/or exterior equipment (modules and/or systems) are positioned in the same locations in and/or on the standard shell, which allows the crew to be faced at each moment with a similar operational environment independent of the number and nature of the interior and/or exterior modules and/or systems.

The specific dimensions of each plate are not considered to be a limiting and restrictive element with respect to the invention. Indeed, some variations may appear (for example, an increase thereof), but will in no way modify the standardization of the shell. They will potentially favor an increase of the available interior space in order to attach larger modules and/or systems (volumetric aspect) or more modules and/or systems (quantitative aspect).

Figure 2:
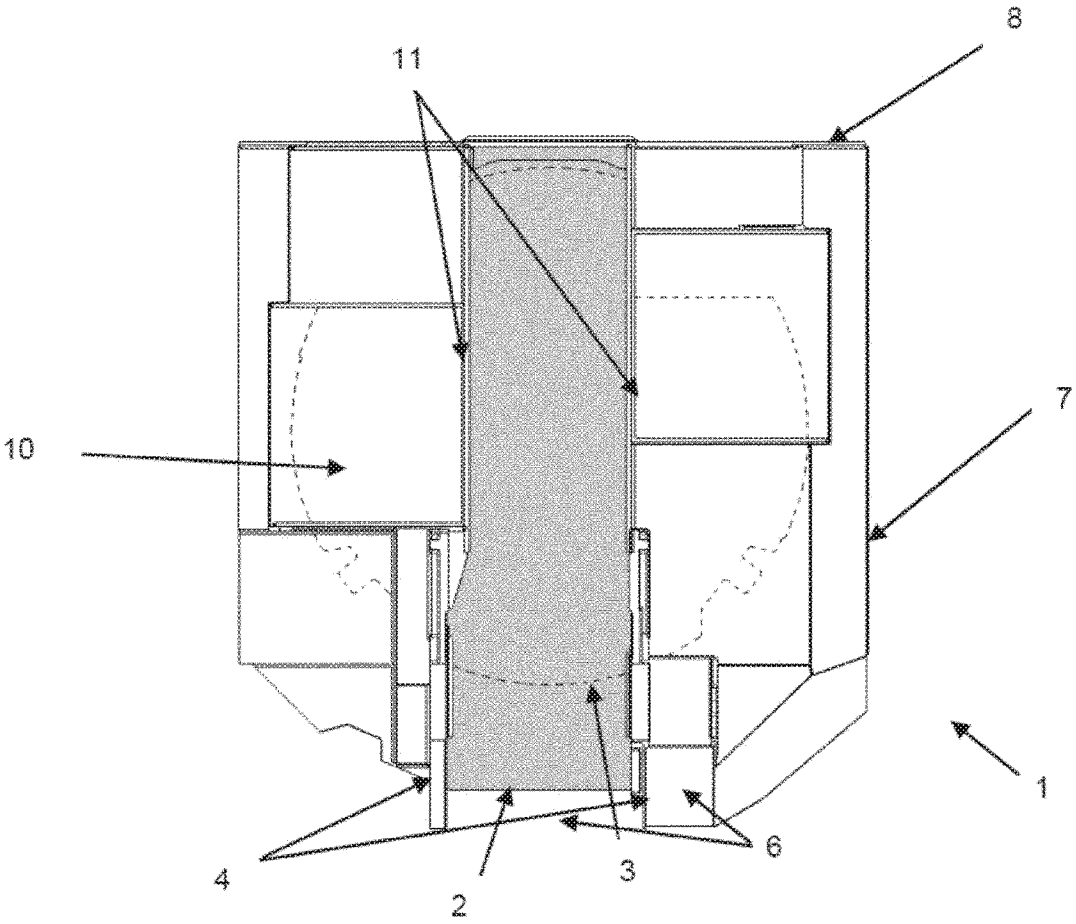
FIG. 2 is a planar view of the standard and interchangeable shell shown in FIG. 1.
Figure 3:
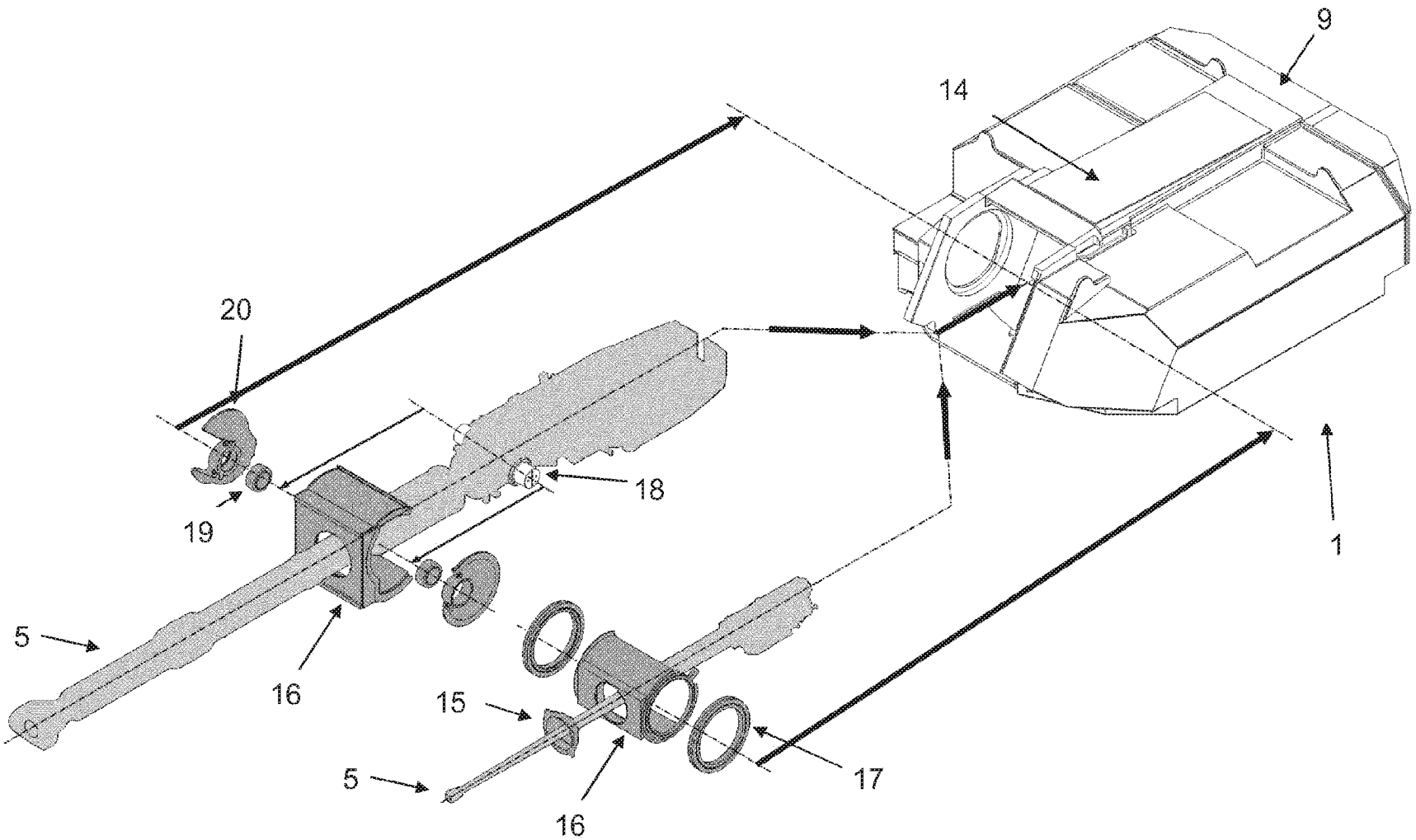
FIG. 3 shows an exploded view of the fastening system for the large-caliber and medium-caliber cannon module, respectively.
Figure 4:
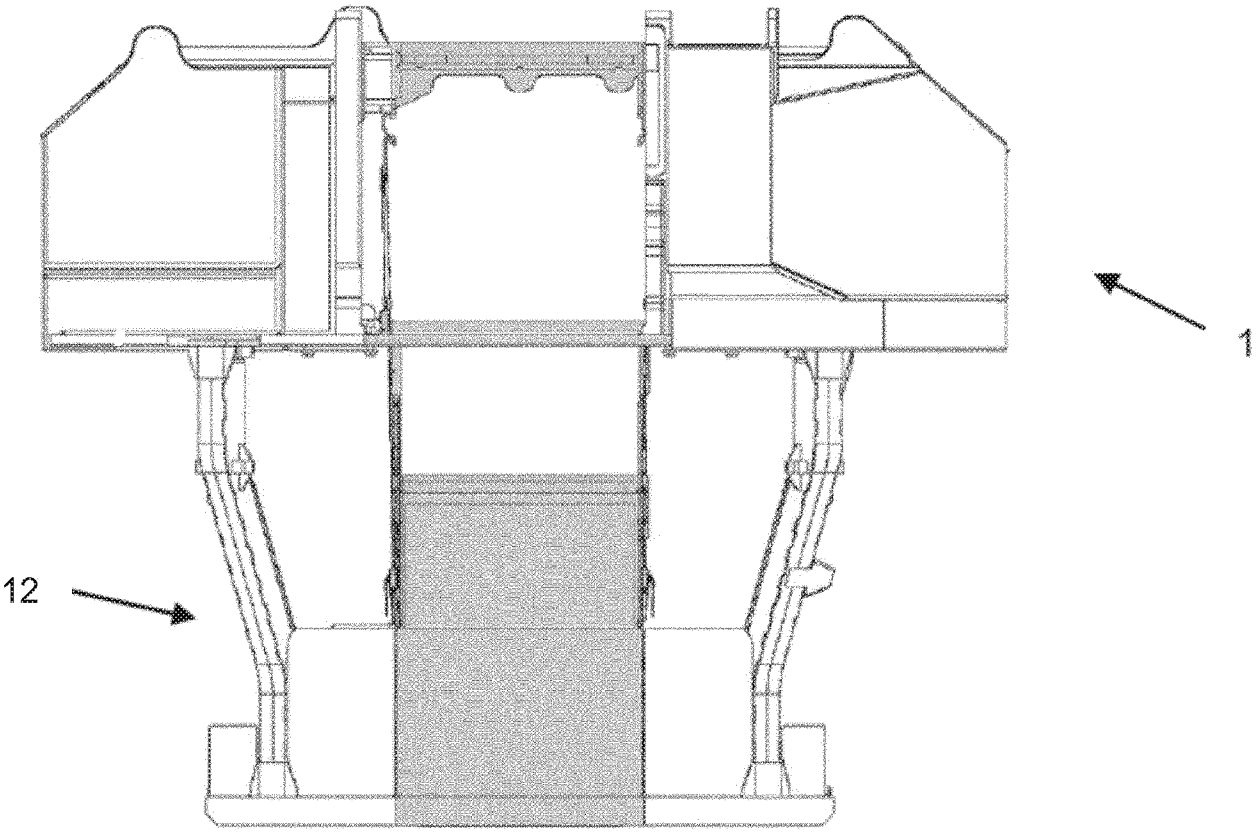
FIG. 4 is a front view of the standard and interchangeable shell associated with the basket.

As shown primarily in FIGS. 1, 2 and 3, among the plates defined above associated with the standard shell 1, the following elements appear:

base metal sheet 2: plate making up the base of the standard shell 1 over the entire surface area of the shell 1 and the center of which is pierced to define the fastening of the ring 3. This constitutes the interface between the vehicle and the standard shell 1. The diameter of the ring 3 varies depending on the type of vehicle, i.e., it oscillates between 1200 mm and 2200 mm;

cannon support plates 4: two structured components positioned perpendicular relative to the base metal sheet 2 and situated in front of the standard shell 1. They are each characterized by an opening intended to receive a medium- or large-caliber cannon module 5 and potentially a small-caliber secondary weapon module 6;

side metal sheets 7: plates starting from the cannon support plates 4, following the base metal sheet 2 and ending behind the standard shell 1. On the front face of the standard shell 1, they have an angle smaller than 90° relative to the base metal sheet 2 (this depends on the associated exterior modules and/or systems), while laterally, they are generally and preferably welded perpendicular to the base metal sheet 2;

interface plate 8: plate connecting the side metal sheets 7 to the rear of the standard shell 1. In other words, this plate 8 is inserted perpendicular to the base metal sheet 2. It is considered as fastening means with the bustle rack 9, the bustle rack 9 being the structure serving, inter alia, as ammunition case, but also being able to perform other functions subject to several developments. For the medium-caliber cannon module 5, the interface plate 8 marries the base 2 and side 7 metal sheets over a width of several millimeters such that the bustle rack 9 is in direct relation with the standard shell 1, which allows the ammunition rack (or any device for storing and conveying ammunition) to simultaneously straddle the standard shell 1 and the bustle rack 9. In the case of the large-caliber cannon module 5, said interface plate 8 has the same characteristics and functions, but has an additional associated plate, called firewall, comparable to a complete junction (complete closure) between said metal sheets 2, 7, and said bustle rack 9;

upper metal sheets 10: plates closing the standard shell 1 while being associated with the cannon support plates 4, side metal sheets 7 and interface plate 8;

arches 11: structures providing the junction between the front and rear of the standard shell 1. They appear in the form of a rectilinear channel i) coming from the cannon support plate 4 up to the interface plate 8 in order to stiffen the standard shell 1, and ii) characterized by a certain fixed height. Thus, as shown by FIG. 4, they systematically define three identical zones from a functional and structural perspective, independently of the cannon module 5, encountered inside the standard shell 1, i.e., a "gunner" zone on the right, looking from the front of the vehicle, a "commander" zone on the left, and a "central" zone intended to receive the primary weapon 5. These three specific zones appear similarly at the basket 12 located inside the modular turret 13. During shooting, certain components of the cannon module 5 experience kickback. This is significant for large-caliber ammunition, and insignificant in the case of medium-caliber ammunition. To incorporate this physics phenomenon, a cover 14 has been placed, over the arches 11, the shape, and therefore height, of which therefore depend on the kickback created by certain components of the cannon module 5. That is why in addition to its armoring function, the cover 14 has a structural function imparting additional rigidity to the standard shell 1.

Now from a functional perspective, the standard shell 1 described above has the characteristics of being interchangeable with respect to an entire series of interior and/or exterior modules and/or systems. The latter are integrated/attached on the standard shell 1 according to the appropriate fastening methods and based on criteria defined both by the user and the mission stakes. In fine, the characteristic arrangement of the set of modules described below makes it possible to obtain a modular tower 13 from a standard and interchangeable tower 1.

Among the different modules and/or systems, the integration of the cannon module 5 constitutes the heart of the present invention. It is done at the front face of said standard and interchangeable module 1, and conditions any thought process related to the interchangeability and size of the latter.

The cannon module 5 is:

characterized by calibers comprised between 20 mm and 130 mm, in other words, calibers covering the range of medium and large calibers. The choice of caliber of the cannon module 5 depends on requirements from the user as well as the considered missions;

secured to the standard and interchangeable shell 1 by a specific interface system, the interfacing system copying the specificities of the interfaces both of the standard and interchangeable shell 1 and the cannon module 5.

Thus, at the fastening system (FIG. 3), two approaches have been favored in the present invention:

the first goes through a support 15 (which may be optional), the mask 16 and rolling bearings 17;

the second approach favors the use of journals 18, ball joints 19 and flanges 20.

In both cases, it is possible to integrate either the medium-caliber cannon module 5 or the large-caliber cannon module 5, which is reflected by the fact that the fastening module is optimized based on the caliber of the considered cannon module 5, while the interface of the standard and interchangeable shell 1 is independent of said caliber. This means that the support 15 (which may or may not be present), the mask 16 and the rolling bearings 17 as well as the journals 18, ball joints 19 and flanges 20, are considered to be intermediate fastening parts that are very easily interchangeable on the standard and interchangeable shell 1.

Thus, the standard and interchangeable shell 1 is not dedicated beforehand to a cannon module 5 with a defined caliber, but has been designed and geometrically optimized for a range of calibers of the inserted cannon module 5.

The standardization/neutrality of the standard and interchangeable shell 1 also remains valid with respect to vehicles, i.e., all of the geometric and functional parameters have been optimized irrespective of the vehicle on which said standard and interchangeable shell 1 rests.

Furthermore, the optimization of the geometry of the standard and interchangeable shell 1 accounts for the movement of certain components of the cannon module 5, said movement relative to a horizontal axis parallel to the base metal sheet 2 having both an elevation and a depression. Thus, in one preferred embodiment of the invention, in the case of the mechanical stop, the elevation reaches a value of +42°, while the depression indicates a value of −10° for the large-caliber cannon module 5, while the values are +60° and −10°, respectively, for the medium-caliber cannon module 5. In light of these geometric and numerical characteristics, the object of the invention shows the compromise between the latter as a function of contractual requirements. It should be noted that these angular values can fluctuate more subject to several modifications in terms of the integration of interior modules and/or systems.

In light of the geometric characteristics described above, and taking into account the caliber of the cannon module 5, it appears that, at the ring 3, the rotation axis of the standard and interchangeable shell 1, and implicitly the modular turret 13, is symmetrical in all scenarios. Conversely, the positioning of the cannon module 5 is not identical as a function of the studied caliber: i) for the large-caliber cannon module 5, the latter 5 is centered relative to the standard and interchangeable shell 1, whereas ii) for the medium-caliber cannon module 5, this 5 can be slightly off-centered, for example, to facilitate the transverse supply of ammunition.

The secondary weapon module 6 is generally likened to a coaxial machine gun characterized by a caliber ranging from 5.56 mm to 15 mm, the caliber of the cannon module 5 being of little importance, and preferably 7.62 mm.

Like the fastening modules previously defined for the cannon module 5, the positioning of the secondary weapon module 6 is independent of the caliber of the cannon module 5, but has preferably been selected based on constraints proposed by each of them. In other words, even though the structural aspect allows any insertion, the functional aspect plays a decisive role in the choice of the location.

As a result, the three integration possibilities for the secondary weapon module 6 are as follows: i) the distance between the two cannon support plates 4 is such that it is possible to jointly insert the cannon module 5 and the secondary weapon module 6 therein, which means that they are fastened directly on the mask 16, ii) the secondary weapon module 6 is integrated outside said mask 16 considering the cannon module 5 inserted alone between the two cannon support plates 4, and iii) the secondary weapon module 6 is located both on and outside the mask 16, in which case the standard and interchangeable shell 1 contains two secondary weapon modules 6 simultaneously in the presence of the cannon module 5.

According to the aforementioned characteristics, the coaxiality is based on the fact that the main axis of the machine gun 6 is in the same direction and sense as those defined by the cannon module 5. For information, it should be noted that the secondary weapon module 6 can also be attached in another location on the standard and interchangeable shell 1, this location not necessarily being close to the cannon module 5.

In addition to the cannon module 5, the present invention makes it possible to incorporate other modules and/or systems on the standard and interchangeable shell 1 without modifying the structural and functional aspects of the latter 1. In other words, the integration of the latter is also independent of the caliber of the cannon module 5 following a significant set of interface means for each of them.

In other words, the exterior and/interior modules and/or systems are interchangeable both for the means and for the large calibers of the cannon module 5, such that the crewmembers can be faced with a similar working environment at all times in terms of ergonomics, functionalities, etc.

Among the various considered modules and/or systems, at least one module and/or system (or a combination of said modules and/or systems) is systematically or optionally used (FIGS. 4 and 5):

i) the ammunition storage module, formed by a closed and armored metal structure, the bustle rack 9, comprising, depending on the caliber of the cannon module 5, an automatic or manual ammunition rack.

The bustle rack 9 is attached behind the standard and interchangeable shell 1 at the interface plate 8 by specific securing means, simultaneously incorporating sealing means. According to the invention, a screw/nuts approach associated with sealing means has been selected.

The size of the bustle rack 9 depends on the caliber of the cannon module 5 and the quantity of ammunition on board.

In the case of:

large-caliber ammunition, the storage thereof is done only in the bustle rack 9, so as optionally to mount a firewall between the latter 9 and the standard and interchangeable shell 1;

medium-caliber ammunition, it is located both in the standard and interchangeable shell 1 and the bustle rack 9 continuously, with no firewall.

The supply of ammunition to the cannon module 5 and, in fine, the ejection of the latter (called "primary ammunition") is done from the rear (bustle rack 9) toward the front (cannon module 5) of the standard and interchangeable shell 1 using two different approaches:

for large-caliber ammunition, it is conveyed automatically or manually, longitudinally, along the same axis as that defined by the cannon module 5;

after shooting, only the cartridge cases are ejected downward and recovered manually by the inside operator, for medium-caliber ammunition, it is conveyed along a transverse path through a series of specific devices (ratchet boxes, conveyors and hoses) located at the side metal sheet 7 on the commander side in the case at hand, which allows the hoses to pass through the left cannon support plate 4 in order to free the ammunition in the cannon module 5;

after shooting, the cartridge cases are ejected automatically either through the front of the mask 16 through an opening located at the height of the cannon module 5, or laterally with respect thereto 16, while the links are discharged by the opposite (right) cannon support plate 4 through specific conduits.

For the secondary weapon module 6, the ammunition (called "secondary ammunition") is stored in a box inside the standard and interchangeable shell 1 and is conveyed to said secondary weapon module 6 only by the action of the latter 6. The operating mode is based on the following approaches:

a system based on gas recovery;

a system based on exploiting the kickback from the secondary weapon module 6, or a motorization of said secondary weapon 6.

It should be noted that in some scenarios, this power supply is done using hoses in order to reach the cannon support plate 4.

The ejection of this secondary ammunition follows two specific approaches:

for a large-caliber cannon module 5, the secondary ammunition is ejected and recovered in a collector;

for a medium-caliber cannon module 5, the secondary ammunition is ejected either through specific conduits located between two cannon support plates 4, such that they automatically end their travel outside the modular turret 13 like the links of the main ammunition, or inside the vehicle below the base metal sheet 2, causing a more significant intrusion, and therefore greater bulk. Upstream from these two operations (conveying and ejection), the (re)loading of ammunition appears. The caliber of the latter is of little importance; it is done either from outside the modular turret 13, or from inside the latter 13, depending on its optimized and structured layout and architecture. In both scenarios, it is the set of conditions (threats from the enemy, relief of the terrain, etc.) where the crewmembers are found that preferably conditions an approach.

ii) the area intended for the crew, also called the basket 12, which is fastened to the standard and interchangeable shell 1 at the base metal sheet 2 by securing means.

This structure, which is generally made from metal, has the command and shooting stations for the commander and the gunner, respectively, the stations being equipped with various electronic and/or mechanical devices for controlling the modular turret 13 (HMI, Human Machine Interface) that are necessary and essential for the associated actions.

Furthermore, it is characterized by a third zone at which certain components of the cannon module 5 are inserted exclusively during shooting, which means that it is completely secure for the crewmembers.

The nature of the basket 12 is independent of the caliber of the cannon module 5; in other words, this is a standard structure characterized by an arrangement customized as a function of the user's requests.

Figure 5:
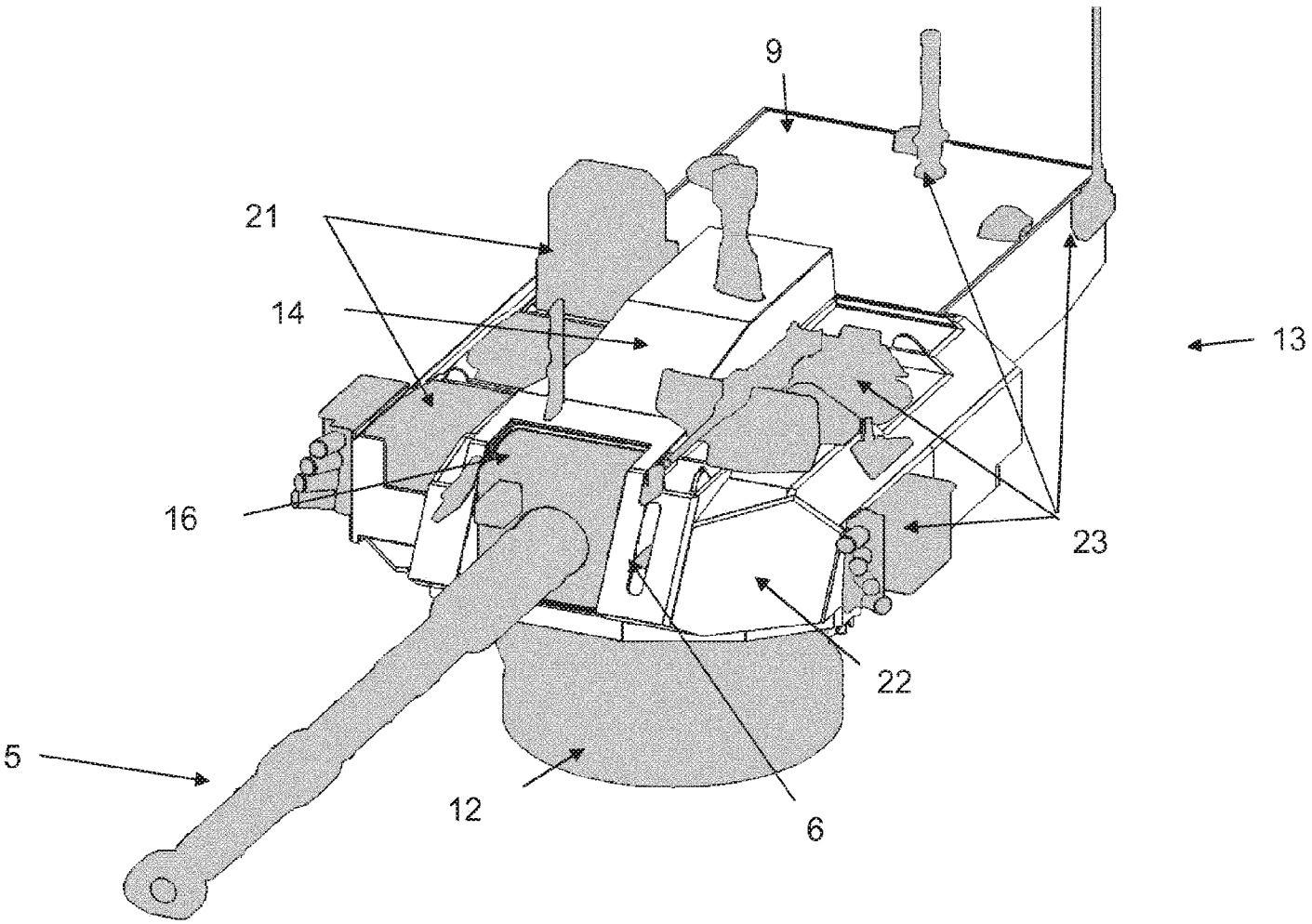
FIG. 5 shows a perspective view of the location of the different modules and/or systems.

In some scenarios, the modular turret 13 is characterized by an absence of basket 12, which results in control from the inside of the vehicle itself iii) the aiming system 21 is inserted (in)directly on the upper metal sheet(s) 10. An example configuration is shown in FIG. 5.

The securing means depend on the specificities of each commercially available aiming system.

iv) regarding the aspect related to the armor, said standard and interchangeable shell 1 is made up of an armored outer enclosure subdivided into specific zones, geometrically speaking, defined either by the location of the exterior modules and/or systems, or by blank spaces potentially able to be used later to attach one (or several) exterior module(s) and/or system(s).

Certain zones may be subject to a different armor index, given that they contain/protect a more vulnerable environment such as occupants, ammunition, etc. Thus, the over-armor is reflected by the fact that an additional armor kit 22 is placed at the specific locations of the standard and interchangeable shell 1.

In other words, the ballistic protection is not uniform over the entire standard and interchangeable shell 1, but meets the interior constraints (person and/or material) as well as the user's requirements. Thus, metal connectors provide the junction between the standard and interchangeable shell 1 and said kit 22, and their number is considered to be fixed per standard and interchangeable shell 1. However, depending on the over-armor desired by the user, they are not all systematically used. If said over-armor must evolve over time, the unused connectors may again be functional subject to certain adaptations. An example configuration is shown in FIG. 5.

v) a missile launcher system, a grenade launcher system, a close-up observation system, a radio communication system, a weather station, hatches, episcopes, a roof weapon system, a laser beam detection system, a navigation system, an electronic control system, a power system, an under-shield "boresight" system 23, etc., is/are connected to the standard and interchangeable shell 1 by a support system and a screw and nuts assembly. The fastening is done either at the side metal sheets 7 or the bustle rack 9, etc.

An example configuration is shown in FIG. 5.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOLS

1 shell
2 base metal sheet
3 ring
4 cannon support plate
5 cannon module
6 secondary weapon
7 side metal sheet
8 interface plate
9 bustle rack
10 upper metal sheet
11 arch
12 basket
13 turret
14 cover
15 support
16 mask
17 rolling bearing
18 journal
19 ball joint
20 flange
21 aiming system
22 over-armor
23 hatch, episcope, etc.

The invention claimed is:

1. A modular turret for an armored vehicle, comprising:

an invariable and unique basic structural unit configured to be interchangeable, called a standard shell, equipped with interface means; and a plurality of interchangeable and removable functional structures securable to the standard shell by fastening means which are specific and distinctive for a connection of each functional structure to the standard shell, the interface means being configured to allow an assembly of a set of different structures of a same functional type on the standard shell at an interfacing zone on the latter, wherein the standard shell comprises an assembly of a plurality of plates with different shapes and sizes giving the standard shell a geometric shape with fixed dimensions, the plates having at least one of orifices or connectors configured to fasten the interchangeable and removable functional structures, the plurality of plates comprising:

a base metal sheet comprising a base of the standard shell over an entire surface area thereof, and a center of which is pierced to define a fastening of a ring;

two cannon support plates situated in front of the standard shell, and positioned perpendicular relative to the base metal sheet, each of the two cannot support plates comprising an orifice configured to receive at least one of a cannon module or a secondary weapon module;

side metal sheets starting from the cannon support plates, following the base metal sheet to end behind the standard shell;

an interface plate connecting the side metal sheet to a rear of the standard shell perpendicular to the base metal sheet, the interface plate comprising a fastening means for a bustle rack;

upper metal sheets cooperating with the cannon support plates, the side metal sheets, and the interface plate so as to close the standard shell, and wherein the standard shell further comprises:

two arches providing a junction between the front and rear of the standard shell, the two arches having a fixed height and forming a rectilinear channel extending from the cannon support plates to the interface plate, so that the arches define, inside the standard shell, three invariable zones independently of an actual cannon module, a position of the arches defining fictive plans which, once extended downward with respect to the base metal sheet, make similarly appear the three invariable zones at a level of a basket mounted on the standard shell; and a cover, over the arches, at least one of a shape or a height of which reflects a recoil created by the cannon module.

2. The modular turret according to claim 1, wherein the interchangeable and removable functional structures are selected, systematically or optionally, from the group consisting of: a cannon module in a specific caliber range, for medium to large calibers; a small-caliber secondary weapon module; a basket; an aiming system; an ammunition storage or bustle rack module; an over-shield kit; a missile launcher system; a grenade launcher system; a close-up observation system; a radio communication system; a weather station; hatches; episcopes; a roof weapon system; a laser beam detection system; a navigation system; an electronic control system; a power system; and an under-shield "boresight" system.

3. The modular turret according to claim 2, wherein a caliber of the cannon module is between 20 and 130 mm.

4. The modular turret according to claim 1, wherein the side metal sheets have an angle smaller than 90° relative to the base metal sheet on the front face of the standard shell, and are welded perpendicular to the base metal sheet on the lateral sides.

5. The modular turret according to claim 1, wherein the cannon module is interfaced with the standard shell between the cannon support plates, either via a support, mask, and rolling bearings, or via journals, ball joints, and flanges, the fastening being configured to be independent of a caliber of the cannon module.

6. The modular turret according to claim 1, wherein the secondary weapon module is interfaced with the standard shell, either jointly with the cannon module between the cannon support plates at a mask such that the cannon module and the secondary weapon module are both fastened on the mask, or outside the cannon support plates such that the secondary weapon module is integrated outside the mask, or both at once between and outside the cannon support plates, the fastening being independent from the caliber of the cannon module.

7. The modular turret according to claim 6, wherein a main axis of the secondary weapon module is oriented in a same direction and sense as a main axis of the cannon module such that a coaxiality appears between the two weapons.

8. The modular turret according to claim 1, wherein at least one of an ammunition storage or a bustle rack module is interfaced with the standard shell behind the latter via the interface plate acting as bustle rack fastening means, the latter respectively being:

in direct relation with the standard shell in the case of the medium-caliber cannon module, such that an ammunition rack of the modular turret simultaneously straddles the standard and interchangeable shell and the bustle rack, the interface plate marrying the base and side metal sheets over a width of several millimeters; or in indirect relation with the standard shell in the case of the large-caliber cannon module, following a presence of at least one of a firewall, or an additional plate, comparable to a complete junction, the interface plate closing an entire rear surface area of the standard shell by connecting the base and side metal sheets, the bustle rack containing ammunition conveyable to the cannon module automatically, respectively:

longitudinally along an axis thereof by the large-caliber cannon module, and transversely to an axis thereof by the medium-caliber cannon module.

9. The modular turret according to claim 1, wherein the plurality of interchangeable and removable functional structures is specifically attached to same locations of the standard shell without modifying structural and functional aspects of the standard and interchangeable shell and independently of a caliber of the cannon module.

10. The modular turret according to claim 1, wherein unused interfacing zones are covered with closed blank plates.

11. The modular turret according to claim 1, wherein the assembly of the plurality of plates with different shapes and sizes giving the standard shell a geometric shape with fixed dimensions comprises a mechanically welded assembly.

12. The modular turret according to claim 1, wherein the plurality of interchangeable and removable functional structures, irrespective of their specificity, is attached to same locations of the standard shell, this association, in terms of a geometry of the standard shell as well as the fastening methods, being independent of a number and nature of the structures, whether they are interior or exterior, such that an immediate control environment in which a crew of the modular turret is found, as well as a position of the crew, remain identical at all times while a configuration of the modular turret is not frozen in time, but can evolve over time, depending on updates as well as requests from a user.

13. The modular turret according to claim 1, wherein the three invariable zones comprise a zone for hosting a gunner on the right, looking from a front of the vehicle, a zone for hosting a commander on the left, and a central zone configured to receive the primary weapon.

14. The modular turret according to claim 10, wherein the closed blank plates are armored using an additional armoring kit.

15. The modular turret according to claim 12, wherein the immediate control environment comprises a human machine interface or seats.

16. The modular turret according to claim 12, wherein the crew comprises no more than two people.

17. The modular turret according to claim 16, wherein the two people comprise a commander and a gunner.

18. The modular turret according to claim 12, wherein the standard shell or the modular turret is based on a commonality of a management of the various structures.

* * * * *